US006402488B2

(12) United States Patent
Watanabe et al.

(10) Patent No.: US 6,402,488 B2
(45) Date of Patent: Jun. 11, 2002

(54) OIL PUMP

(75) Inventors: Kenichi Watanabe, Takarazuka; Keizo Harada, Itami; Koichi Sogabe, Itami; Toshiyuki Kosuge, Itami, all of (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/769,463

(22) Filed: Jan. 26, 2001

(30) Foreign Application Priority Data

Jan. 31, 2000 (JP) ..... 2000-021202

(51) Int. Cl.[7] ..... F01C 21/00

(52) U.S. Cl. ..... 418/178; 418/179; 418/171; 384/477; 384/902

(58) Field of Search ..... 418/178, 171, 418/179; 384/902, 477

(56) References Cited

U.S. PATENT DOCUMENTS 3,827,835 A * 8/1974 Higuchi et al. ..... 418/178
3,918,137 A * 11/1975 Telang et al. ..... 418/178
3,918,923 A * 11/1975 Inoue ..... 418/178
4,549,862 A * 10/1985 Stich et al. ..... 418/178
4,764,098 A * 8/1988 Iwase et al. ..... 418/178

FOREIGN PATENT DOCUMENTS

| | | | |
|---|---|---|---|
| JP | 59-212159 | * 12/1984 | ..... 418/178 |
| JP | 60-173387 | * 9/1985 | ..... 418/178 |
| JP | 01-170782 | * 7/1989 | ..... 418/179 |
| JP | 02-011738 | * 1/1990 | ..... 418/179 |
| JP | 03-15832 | 4/1991 | |
| JP | 05-288176 | * 11/1993 | ..... 418/178 |
| JP | 08-319504 | * 12/1996 | ..... 418/178 |

* cited by examiner

*Primary Examiner*—Thomas Denion
*Assistant Examiner*—Theresa Trieu
(74) *Attorney, Agent, or Firm*—McDermott, Will & Emery

(57) ABSTRACT

An oil pump that can be reduced in weight and is excellent in wear resistance and easy to manufacture is provided. The oil pump includes an oil pump housing formed of aluminum alloy, and an inner rotor and an outer rotor that slide along the oil pump housing with contact kept therebetween to suck and discharge oil. Composite layers including porous metallic bodies are arranged at parts of the oil pump housing that contact the inner rotor and the outer rotor. Pores of the porous metallic bodies are impregnated with the aluminum alloy constituting the oil pump housing.

10 Claims, 4 Drawing Sheets

OIL PUMP

BACKGROUND OF THE INVENTION

1. Field of the Invention

The present invention relates to oil pumps and particularly to an oil pump for an automatic transmission system employed in a vehicle such as automobile.

2. Description of the Background Art

An oil pump for an automatic transmission used in a vehicle like automobile is constituted of a rotor that revolves and an oil pump housing that encases the rotor. The rotor and oil pump housing are generally formed of iron (cast iron).

In recent years, reduction in weight of automobiles as well as oil pumps for automatic transmissions has been required for improvement of fuel economy. Then, use of aluminum alloy has been considered as a material constituting the oil pumps. However, the rotor, as a component of the oil pump, is made of an iron-based material because of the requirement of a high wear resistance of the rotor and a low weight ratio of the rotor itself to the entire oil pump, and the like. On the other hand, the oil pump housing is effectively constituted of aluminum alloy for reducing the weight since the weight of the oil pump housing accounts for most of the total weight of the oil pump.

If the rotor made of the iron-based material and the housing made of aluminum alloy are combined, a problem arises that a part of the oil pump housing, along which the rotor slides while contact is kept therebetween, is likely to wear because of an inferior wear resistance of the aluminum alloy.

An invention for improving the wear resistance of the oil pump housing is disclosed, for example, in Japanese Utility Model Publication No. 3-15832. According to this invention, the wear resistance is enhanced by dispersing ceramic fibers in a part of the oil pump housing, along which the rotor slides while contacting therewith, and thus producing a composite material.

This invention has a problem in terms of handling that the formability of the ceramic fibers is poor because the ceramic fibers are chopped fibers and accordingly the shape is likely to be lost. When ceramic fibers are impregnated with aluminum alloy to produce a composite, the impregnation requires a significantly high pressure. Consequently, any special equipment is necessary which increases equipment cost. Further, the shape of a mold is limited and accordingly the degree of freedom of pump design is restricted. There is a further problem in the actual manufacture that machinability in a cutting process after the composite is produced is poor.

SUMMARY OF THE INVENTION

The present invention is made to solve the problems mentioned above. One object of the invention is to provide a lightweight oil pump that is superior in wear resistance and productivity.

An oil pump according to the present invention includes an oil pump housing formed of aluminum alloy and a pump element sliding along the oil pump housing while contacting therewith to suck and discharge oil. A porous metallic body having a foam structure is embedded in a part of the oil pump housing that contacts the pump element, and pores of the porous metallic body are impregnated with the aluminum alloy constituting the oil pump housing.

The oil pump with such a structure has the porous metallic body embedded in the part contacting the pump element, and thus the wear resistance of the part contacting the pump element is improved. The oil pump housing is made of the aluminum alloy which is light, and thus the oil pump can be reduced in weight. Further, the porous metallic body is easily processed, cut, for example, and has a sufficient stiffness as a structure owing to the metallic properties and thus the porous metallic body is easily processed and formed into any complex shape and maintained as it is, providing a superior productivity.

Impregnation with the aluminum alloy is easily accomplished because of the form structure and accordingly manufacture requires no special equipment. Consequently, a lower equipment cost and fewer limitations of the mold shape are achieved which enhances the degree of freedom of pump design. Compared with the ceramic fibers, the porous body impregnated with aluminum alloy has an improved machinability and thus an oil pump superior in wear resistance and productivity can be provided.

Preferably, the pump element has a rotor that revolves and a porous metallic body is embedded in a part that contacts a side surface of the rotor.

Still preferably, the pump element has a rotor that revolves and a porous metallic body is embedded in a part that contacts the peripheral surface of the rotor.

Still preferably, the average pore diameter of the porous metallic body is at least 0.1 mm and at most 3.0 mm. The porous metallic body according to the present invention has the structure as shown in FIG. 4. The average pore diameter of the porous metallic body is measured in the following way. First, a picture is taken of an arbitrarily selected cross section of the body, the picture corresponding to a rectangular photographic field. Then, respective lengths of pores crossed by two diagonal lines in the rectangular field are measured. Finally, the sum of the pore lengths is divided by the total number of those pores and accordingly the average pore diameter is determined. It is noted that the pore diameter of the porous metallic body herein refers to the general term used in the art that represents an average diameter of pores of a base material such as urethan foam.

The optimized average pore diameter allows easier impregnation with the aluminum alloy and improves the wear resistance. If the average pore diameter is less than 0.1 mm, the smaller pores deter impregnation with the aluminum alloy. If the average pore diameter exceeds 3.0 mm, the area of the exposed skeleton of the porous metallic body per unit area decreases, which lowers the effect of enhancing wear resistance.

Still preferably, the volume fraction of the porous metallic body is at least 2% and at most 30%. Here, the volume fraction is calculated from (apparent density: density calculated from the outer diameter and weight)/(density of the metallic material constituting the porous metallic body: density of metal)×100%. It is noted that the apparent density is identical in meaning to bulk density, and the density of the metallic material constituting the porous metallic body is identical in meaning to the true density of the metallic material constituting the porous metallic body. The volume fraction represents the amount of metal contained in a certain volume. For example, the volume fraction of 30% means that the metal accounts for 30% of that certain volume and vacancies where no metal exists account for 70% thereof.

This optimized volume fraction can improve the wear resistance and reduce the weight. If the volume fraction is less than 2%, the area of exposed porous metallic body is smaller, which lowers the effect of enhancing the wear resistance. If the volume fraction is more than 30%, the weight of the porous metallic body increases and thus the advantage of reducing the weight cannot be achieved while the wear resistance remains the same.

Still preferably, the porous metallic body contains at least one selected from the group consisting of iron (Fe), nickel (Ni) and chrome (Cr). These metals all have a higher hardness than that of aluminum alloy and thus the wear resistance is improved. For the purpose of cutting the manufacturing cost, a material containing a relatively great amount of iron is preferable. Further, a material containing iron and chrome is more preferable in order to enhance the hardness.

Still preferably, the porous metallic body is formed by sintering. Specifically, metallic powder is attached to urethan foam and the metallic powder is sintered to produce an alloy simultaneously with burning down of the urethan foam. In the process of sintering, the powder shrinks due to the sintering so that the metallic skeleton constituting the porous metallic body becomes solid. Then, all pores are impregnated with aluminum alloy and an enhanced wear resistance is exhibited. Alternatively, the porous metallic body can be produced by forming a metallic layer on a surface of urethan foam through plating. If the plating is employed for production, the urethan foam as a base material is burned down after a metallic skeleton is formed. Because of this, the skeleton structure of the porous metallic body is hollow. In this case, any defective portion could be generated that cannot be impregnated with molten aluminum alloy.

Still preferably, metal constituting the porous metallic body has a Vickers hardness of at least 100 and at most 1000. The optimized Vickers hardness enhances the wear resistance as well as workability. In addition, any loss or damage due to friction can be eliminated. If the Vickers hardness of the metal constituting the porous metallic body is less than 100, which is almost equal to the hardness of aluminum alloy, the effect of enhancing the wear resistance by producing a composite cannot be achieved. If the Vickers hardness of the metal constituting the porous metallic body exceeds 1000, the porous metallic body becomes brittle resulting in a problem in terms of workability that breakage occurs when a preform is formed for producing a composite. Further, friction in operation of the oil pump causes loss and damage, resulting in deterioration of the wear resistance. If the metal is too hard, the metal delivers a severer attack on the subject material (rotor) to increase damage to the rotor and accordingly any defect occurs.

Still preferably, metal constituting the porous metallic body has a Vickers hardness of at least 120 and at most 300.

Still preferably, the oil pump housing is formed through any of squeeze cast process, die casting process and low pressure die casting process to make the composite of the porous metal and the aluminum alloy through casting. In particular, the low pressure die casting can be advantageous in terms of low equipment cost, and reduced limitations of the shape of a mold and thus an enhanced degree of freedom of pump design.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described in conjunction with the drawings.

Figure 1A:
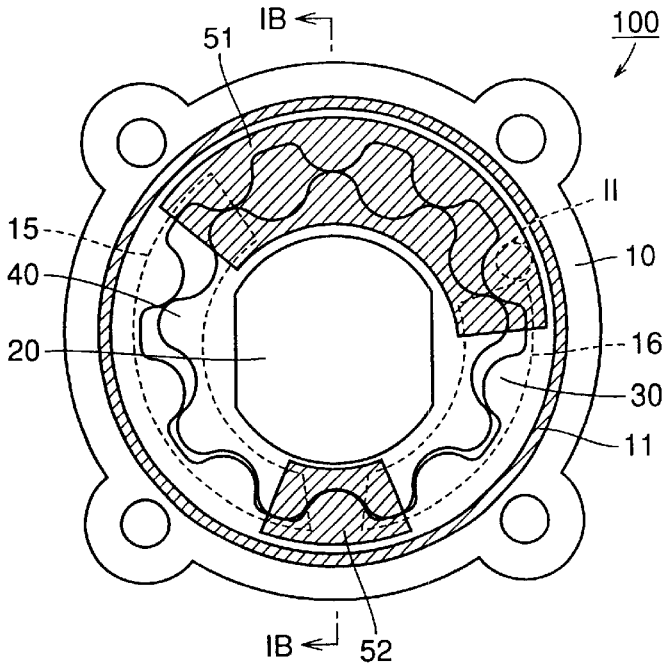
FIG. 1A is a plan view of an oil pump according to the present invention.

Referring to FIG. 1A, an oil pump 100 according to the invention includes a body 10, an inner rotor 40 and an outer rotor 30 as components of a pump element, and an eccentric cam 20. Body 10 has a cylindrical shape in which outer rotor 30 and inner rotor 40 are housed. A composite layer 11 is arranged along the inner circumference of body 10. Composite layer 11 is constituted of a porous metallic body and aluminum alloy with which pores of the porous metallic body are impregnated. The aluminum alloy with which the pores of the porous metallic body are impregnated is aluminum alloy constituting body 10.

Outer rotor 30 is provided to contact the inner perimeter of composite layer 11. Outer rotor 30 slides along composite layers 11, 12 and 13. The inner perimeter of outer rotor 30 has a toothed shape. The toothed shape is based on any of the trochoid, involute and hypocycloid.

Inner rotor 40 is provided to contact the inner perimeter of outer rotor 30. The outer perimeter of inner rotor 40 has a toothed shape based on any of the trochoid, involute and hypocycloid. Inner rotor 40 engaging with the toothed shape of outer rotor 30 can rotate on its axis while revolving around the axis of the body. Eccentric cam 20 is fit in the central portion of inner rotor 40. Eccentric cam 20 provides torque to inner rotor 40 thereby rotates inner rotor 40 with respect to outer rotor 30.

Body 10 has a suction port 15 for drawing oil therein. Suction port 15 passes through body 10 to allow oil to be supplied from the outside to suction port 15. Body further has a discharge port 16 for delivering oil to the outside. Discharge port 16 passes through body 10 to allow the oil supplied from suction port 15 to be discharged to the outside.

A cover is provided to seal inner rotor 40 and outer rotor 30, and composite layers 51 and 52 in the shape of arc are provided to the cover. Composite layers 51 and 52 are constituted of a porous metallic body and aluminum alloy with which pores of the porous metallic body are impregnated. The aluminum alloy with which the pores of the porous metallic body are impregnated is the aluminum body that constitutes body 10.

Figure 1B:
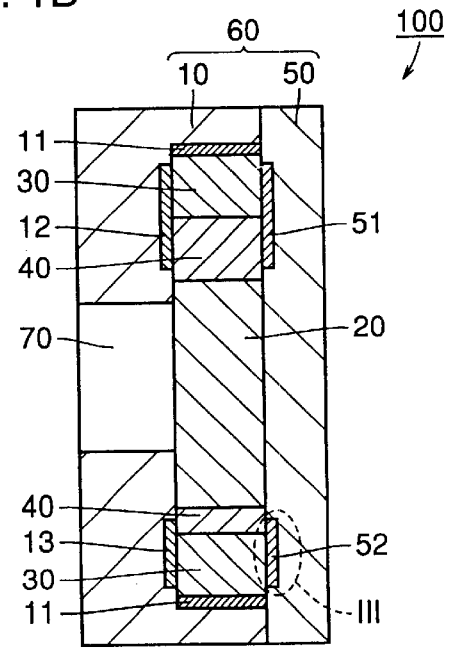
FIG. 1B is a cross sectional view along the line IB—IB in FIG. 1A.

Referring to FIG. 1B, oil pump 100 includes body 10 and cover 50 constituting an oil pump housing 60, inner rotor 40 and outer rotor 30 housed within body 10, and eccentric cam 20 fit in inner rotor 40. A predetermined recess is formed in body 10, and outer rotor 30, inner rotor 40 and eccentric cam 20 are encased in the recess. The recess in the body 10 is sealed with cover 50 made of aluminum alloy. Cover 50 has a disk-like shape to be closely attached to body 10.

Cover 50 has composite layers 51 and 52. Composite layer 51 is produced by impregnating a porous metallic body with aluminum alloy to fill pores of the metallic body with the aluminum alloy. The aluminum alloy is identical to the aluminum alloy constituting cover 50. Composite layer 52 is produced by impregnating a porous metallic body with aluminum alloy to fill pores of the metallic body with the aluminum alloy. This aluminum alloy is identical to the one constituting cover 50. The porous metallic body is embedded in a part of cover 50 that contacts respective side surfaces of inner rotor 40 and outer rotor 30. Composite layer 51 is located at the top dead center of cover 50 while composite layer 52 is located at the bottom dead center of cover 50.

Composite layer 11 is arranged to contact the outer circumference of outer rotor 30. Composite layer 11 arranged along the inner circumference of body 10 is integrated with body 10. Composite layers 12 and 13 are provided to a part of body 10 that contacts respective side surfaces of inner rotor 40 and outer rotor 30. Composite layers 12 and 13 are produced by impregnating a porous metallic body with aluminum alloy to fill pores of the metallic body with the aluminum alloy. This aluminum alloy is identical to the one constituting body 10. The porous metallic body is embedded in a part of body 10 that contacts inner rotor 40 and outer rotor 30. Composite layer 12 is located at the top dead center of body 10 while composite layer 13 is located at the bottom dead center of body 10.

Eccentric cam 20 is provided to fit in inner rotor 40. Eccentric cam 20 can rotate together with inner rotor 40. A shaft 70 is attached to eccentric cam 20. Shaft 70 is eccentrically attached to eccentric cam 20. Shaft 70 can rotate in a predetermined direction. Rotation of shaft 70 causes eccentric cam 20 and inner rotor 40 to rotate together.

Figure 2:
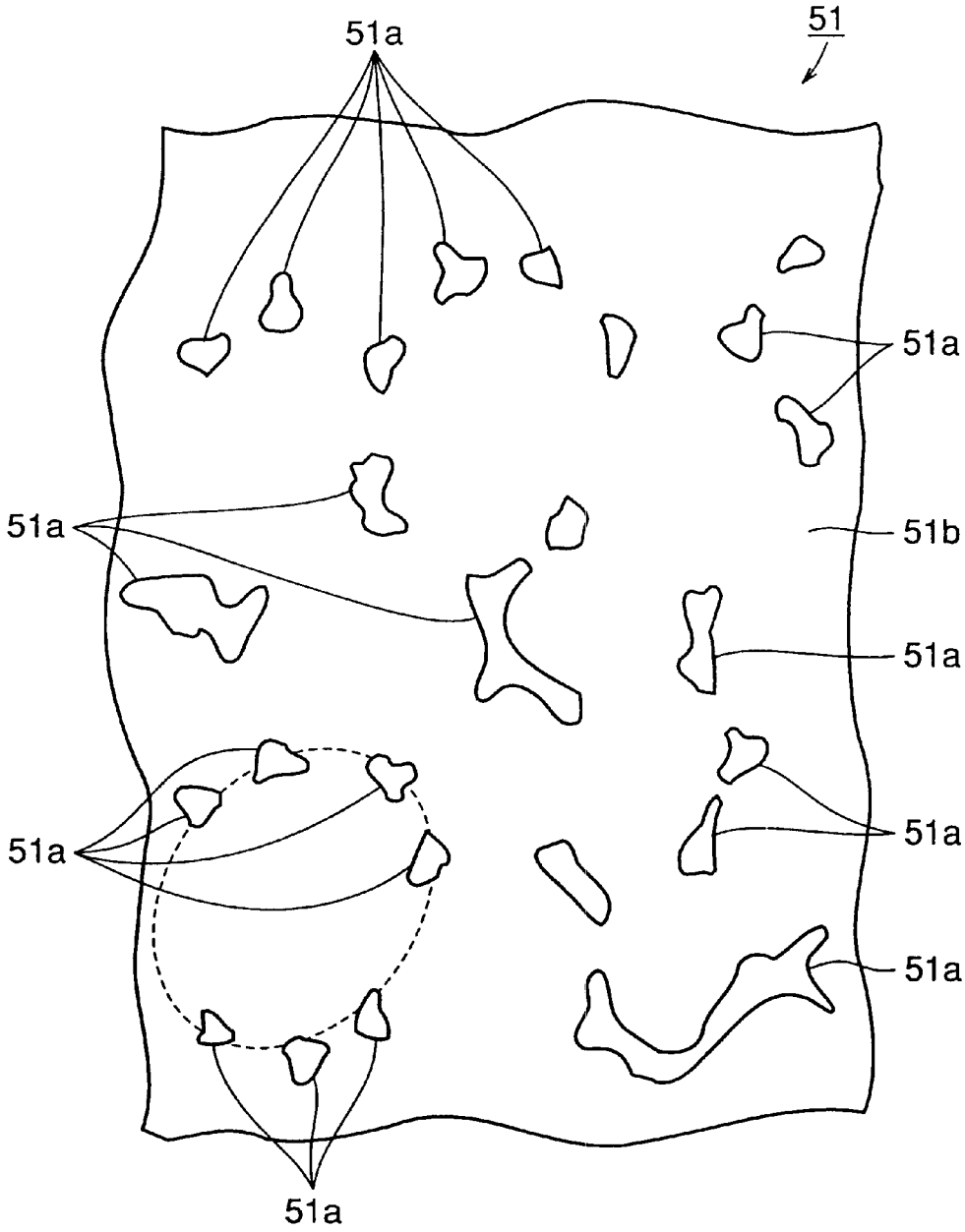
FIG. 2 is an enlarged view of the portion enclosed by the dotted line II in FIG. 1A.

Referring to FIG. 2, the skeleton of a porous metallic body 51*a* in composite layer 51 is partially exposed. The skeleton of porous metallic body 51*a* except for the exposed parts thereof is impregnated with aluminum alloy 51*b* constituting cover 50. Accordingly, aluminum alloy 51*b* adheres to the skeleton of porous metallic body 51*a*.

Figure 3:
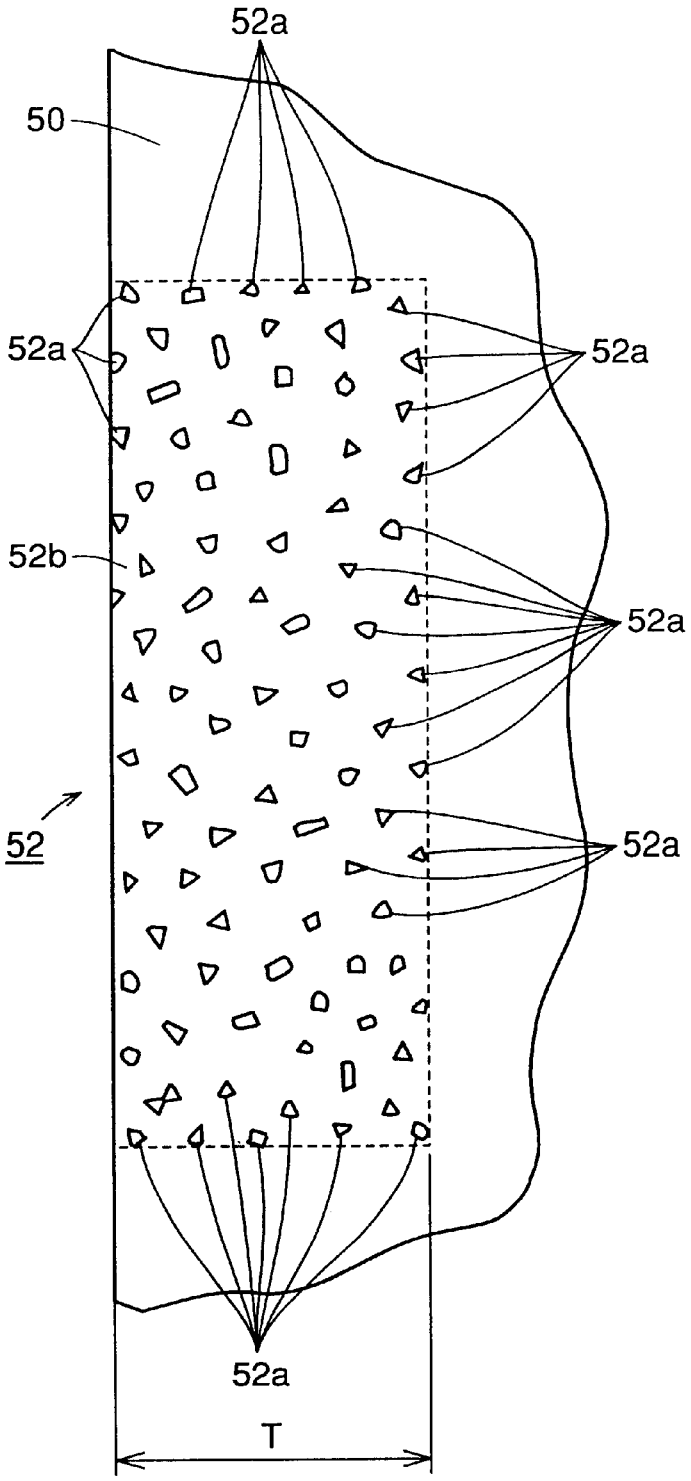
FIG. 3 is an enlarged view of the portion enclosed by the dotted line III in FIG. 1B.

Referring to FIG. 3, composite layer 52 is constituted of the skeleton of a porous metallic body 52*a* and aluminum alloy 52*b* with which pores of porous metallic body 52*a* are impregnated. Aluminum alloy 52*b* is identical to the one constituting cover 50. Composite layer 52 has its thickness T which can appropriately be changed as required.

Figure 4:
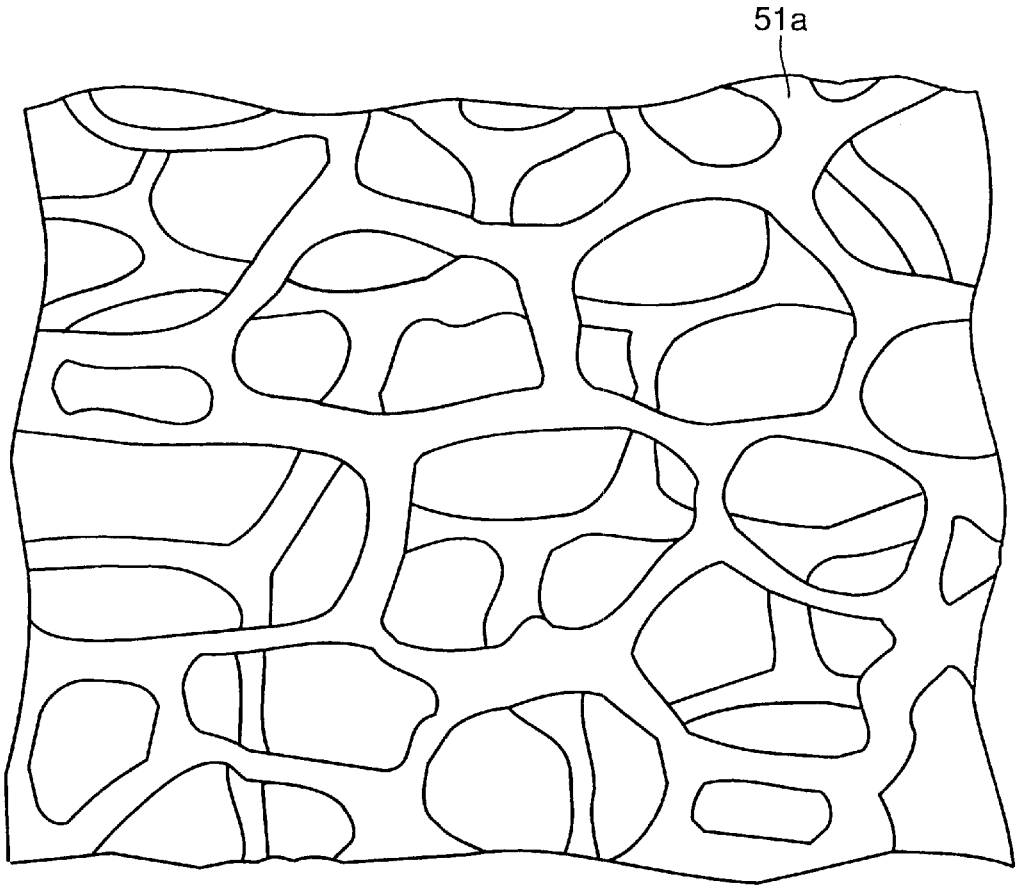
FIG. 4 is a plan view of a porous metallic body shown in FIG. 2.

Referring to FIG. 4, porous metallic body 51*a* has a foam structure as shown in FIG. 4 before being impregnated with the aluminum alloy. Specifically, a large number of pores are formed in porous metallic body 51*a* and these pores are connected to each other. The pore diameter of porous metallic body 51*a* herein refers to the general term used in the art that represents an average diameter of pores of urethan foam which is the base material. Although the skeleton constituting porous metallic body 51*a* seems to be continuous in FIG. 4 since the inner portion of the skeleton can be seen, the skeleton of the porous metallic body 51*b* seems to be discontinuous in FIG. 2 showing only one cross section of the composite material, since the pores are impregnated with the aluminum alloy. As shown in FIG. 2, the round portion indicated by the dotted line can be formed by connecting the separated parts of the skeleton. The diameter of the round portion represents the size (diameter) of a pore of urethan foam or the like.

Oil pump 100 structured in the manner described above has oil pump housing 60, which occupies most of oil pump 100, made of aluminum alloy, and thus the oil pump can be reduced in weight. Further, body 10 and cover 50 made of aluminum alloy have their parts contacting inner rotor 40 and outer rotor 30, and composite layers 11, 12, 13, 51 and 52 are formed at these parts. Consequently, the wear resistance of those parts can be improved. In composite layers 11, 12, 13, 51 and 52, the porous metallic body is impregnated with aluminum alloy. Resultant effects are that the porous metallic body constituting the composite layers is unlikely to be detached from body 10 and cover 50 (anchor effect) and that thermal conductivity of composite layers 11, 12, 13, 51 and 52 is enhanced owing to the aluminum alloy with a high thermal conductivity that fills the pores. Accordingly, heat generated from contact between inner rotor 40 and outer rotor 30 and composite layers 11, 12, 13, 51 and 52 can be effectively released immediately to the outside through composite layers 11, 12, 13, 51 and 52. Porous metallic bodies 51*a* and 52*a* are easy to process and have a sufficient stiffness as structure, therefore, a complicated shape can be achieved by processing. In addition, porous metallic bodies 51*a* and 52*a* are easily impregnated with aluminum alloy, which facilitates manufacture. Consequently, reduction of equipment cost is possible and the degree of freedom of pump design increases owing to reduced limitations of the mold shape.

Examples of the present invention are hereinafter described.

EXAMPLE 1

TABLE 1

| Sample No. | Average Pore Diameter of Porous Metallic Body (mm) | Thickness of Porous Metallic Body (mm) | Volume Fraction (%) |
|---|---|---|---|
| Porous Metallic Body A | 0.08 | 10 | 9 |
| Porous Metallic Body B | 0.1 | 10 | 9 |
| Porous Metallic Body C | 1.5 | 10 | 9 |
| Porous Metallic Body D | 3.0 | 10 | 9 |
| Porous Metallic Body E | 4.0 | 10 | 9 |

Nickel-chrome porous metallic bodies (Ni—Cr porous metallic bodies: Trade name "Celmet" which is manufactured by Sumitomo Electric Industries, Ltd.) A–E having respective average pore diameters different from each other as shown in Table 1 were prepared and they were processed into the shape of the composite layer in FIG. 1.

The processed bodies were each set in a mold and pores of the porous metallic body were impregnated, under a pressure of 40 MPa, with aluminum alloy (JIS AC8A) that was melt by heat at a temperature of 780° C. An oil pump housing was accordingly fabricated. For comparison, an oil pump housing made of aluminum alloy (JIS AC8A) was fabricated with no composite layer. These parts (oil pump housings) were used to produce respective oil pumps each having the inner rotor and outer rotor shown in FIG. 1 that were set in each oil pump housing. The resultant oil pumps products of present invention 1–5 and comparative product 1 were operated under conditions shown in Table 2.

TABLE 2

| | |
|---|---|
| Number of Revolutions | 7000 rpm |
| Oil Temperature | 120° C. |
| Oil Discharge Pressure | 1.5 MPa |
| Operating Time | 200 hours |

After operation of the oil pump, how much the portion where the composite layer was formed (for the comparative product, the portion corresponding to the composite layer of the product of the present invention) wore (wear amount) was measured. Results are shown in Table 3.

TABLE 3

| Sample No. | Used Porous Metallic Body | Wear Amount (μm) |
|---|---|---|
| Present Invention 1 | A | 11 |
| Present Invention 2 | B | 8 |
| Present Invention 3 | C | 6 |
| Present Invention 4 | D | 7 |
| Present Invention 5 | E | 13 |
| Comparative Product 1 | None | 47 |

As seen from Table 3, the products of the present invention have composite layers including porous metallic bodies and thus have improved wear resistance compared with the comparative product having no composite layer. It is also understood that the average pore diameter of the porous metallic body that is at least 0.1 mm and at most 3.0 mm is especially effective for preventing wear.

EXAMPLE 2

TABLE 4

| Sample No. | Volume Fraction (%) | Average Pore Diameter of Porous Metallic Body (mm) | Thickness of Porous Metallic Body (mm) |
|---|---|---|---|
| Porous Metallic Body F | 1 | 0.5 | 10 |
| Porous Metallic Body G | 2 | 0.5 | 10 |
| Porous Metallic Body H | 15 | 0.5 | 10 |
| Porous Metallic Body I | 30 | 0.5 | 10 |
| Porous Metallic Body J | 40 | 0.5 | 10 |

As shown in Table 4, nickel-chrome porous metallic bodies (Ni—Cr porous metallic bodies: Celmet manufactured by Sumitomo Electric Industries, Ltd.) F–J different from each other in volume fraction were processed according to the shape of the composite layer in FIG. 1.

The processed bodies were each set in a mold and pores of the porous metallic body were impregnated, under a pressure of 40 MPa, with aluminum alloy (JIS AC8A) that was melt by heat at a temperature of 780° C. An oil pump housing was accordingly produced. For comparison, an oil pump housing made of aluminum alloy (JIS AC8A) was produced with no composite layer. These parts (oil pump housings) were used to produce respective oil pumps each having the inner rotor and outer rotor shown in FIG. 1 that were set in each oil pump housing. The resultant oil pumps (products of the present invention 6–10 and comparative product 2 were operated under the conditions shown in Table 2. After the operation, the amount of wear of the portion where the composite layer was formed (for the comparative product, the portion corresponding to the composite layer of the product of the present invention) was measured. Results are shown in Table 5.

TABLE 5

| Sample No. | Used Porous Metallic Body | Wear Amount (μm) |
|---|---|---|
| Present Invention 6 | F | 12 |
| Present Invention 7 | G | 9 |
| Present Invention 8 | H | 6 |

TABLE 5-continued

| Sample No. | Used Porous Metallic Body | Wear Amount (μm) |
|---|---|---|
| Present Invention 9 | I | 6 |
| Present Invention 10 | J | 5 |
| Comparative Product 2 | None | 47 |

As seen from Table 5, it is confirmed that the products of the present invention have composite layers including porous metallic bodies and thus have improved wear resistance compared with the comparative product having no composite layer. Further, it is understood that the volume fraction of the porous metallic body that is at least 2% and at most 30% is effective.

EXAMPLE 3

TABLE 6

| Sample No. | Material of Porous Metallic Body | Thickness of Porous Metallic Body (mm) | Average Pore Diameter of Porous Metallic Body (mm) | Volume Fraction (%) |
|---|---|---|---|---|
| Porous Metallic Body K | Ni | 10 | 0.5 | 9 |
| Porous Metallic Body L | NiCr (Cr 25 mass %) | 10 | 0.5 | 9 |
| Porous Metallic Body M | Fe | 10 | 0.5 | 9 |
| Porous Metallic Body N | FeCr (Cr 25 mass %) | 10 | 0.5 | 9 |

As shown in Table 6, porous metallic bodies K–N formed of different materials respectively were processed according to the shape of the composite layer in FIG. 1.

It is noted that the mass % is herein identical to weight %. The processed bodies were each set in a mold and pores of the porous metallic body were impregnated, under a pressure of 40 MPa, with aluminum alloy (JIS AC8A) that was melt by heat at a temperature of 780° C. An oil pump housing was accordingly produced. For comparison, an oil pump housing made of aluminum alloy (JIS AC8A) was produced with no composite layer. These parts (oil pump housings) were used to produce respective oil pumps each having the inner rotor and outer rotor shown in FIG. 1 that were set in each oil pump housing. The resultant oil pumps (products of the present invention 11–14 and comparative product 3) were operated under the conditions shown in Table 2. After the operation, the amount of wear of the portion where the composite layer was formed (for the comparative product, the portion corresponding to the composite layer of the product of the present invention) was measured. Results are shown in Table 7.

TABLE 7

| Sample No. | Used Porous Metallic Body | Wear Amount (μm) |
|---|---|---|
| Present Invention 11 | K | 13 |
| Present Invention 12 | L | 6 |
| Present Invention 13 | M | 10 |
| Present Invention 14 | N | 5 |
| Comparative Product 3 | None | 47 |

As seen from Table 7, it is confirmed that the products of the present invention have composite layers including porous metallic bodies and thus have enhanced wear resistance. Further, it is understood that the material for the porous metallic body is preferably iron-based material in terms of material cost, and metal with its hardness enhanced by adding chrome and the like is more preferable as the material.

EXAMPLE 4

TABLE 8

| Sample No. | Material of Porous Metallic Body | Manufacture Method of Porous Metallic Body | Skeleton Structure of Porous Metallic Body | Thickness of Porous Metallic Body (mm) | Average Pore Diameter of Porous Metallic Body (mm) | Volume Fraction (%) |
|---|---|---|---|---|---|---|
| Porous Metallic Body P | FeCr (Cr25 mass %) | Plating + Alloying | Solid | 10 | 0.5 | 9 |
| Porous Metallic Body Q | FeCr (Cr25 mass %) | Sintering | Hollow | 10 | 0.5 | 9 |

Porous metallic bodies P and Q made of the materials respectively shown in Table 8 were first produced by the methods in Table 8 and then processed according to the shape of the composite layer in FIG. 1.

The processed bodies were each set in a mold and pores of the porous metallic body were impregnated, under a pressure of 40 MPa, with aluminum alloy (JIS AC8A) that was melt by heat at a temperature of 780° C. An oil pump housing was accordingly produced. A housing of product 15 of the present invention was produced by using a porous metallic body formed through the following process. Specifically, urethan foam was used as a base material, the base material is rendered conductive by carbon, plated with iron, and thereafter burned down in an oxidizing atmosphere. A reduction process was performed in a reducing atmosphere and then chrome alloy was produced through a chromizing process (powder pack). In this way, an iron-chrome porous metallic body (Fe—Cr porous metallic body) was produced.

A housing of product 16 of the present invention was produced by using a porous metallic body formed by the process described below. Specifically, urethan foam was used as a base material, the urethan foam was impregnated with slurry composed of iron oxide powder (average particle size 0.5 μm), ferrochrome alloy powder (Cr: 63 mass %, average particle size 5 μm), phenol resin binder and dispersing agent. Excessively adhering slurry was removed by a metal roller and the remaining slurry was dried. Then, annealing in a nitrogen atmosphere at 1100° C. for 10 minutes and further annealing in vacuum at 1200° C. for 30 minutes were performed to produce an iron-chrome porous metallic body (Fe—Cr porous metallic body). For comparison, an oil pump housing made of aluminum alloy (JIS AC8A) was produced with no composite layer. In each of the resultant pump housings, the inner rotor and the outer rotor shown in FIG. 1 were set to produce oil pumps (products 15 and 16 of the present invention and comparative product 4) that were operated under the conditions shown in Table 2. After the operation, the amount of wear of the portion where the composite layer was formed (for the comparative product, the portion corresponding to the composite layer of the product of the present invention) was measured. Results are shown in Table 9.

TABLE 9

| Sample No. | Used Porous Metallic Body | Wear Amount (μm) |
|---|---|---|
| Present Invention 15 | P | 8 |
| Present Invention 16 | Q | 5 |
| Comparative Product 4 | None | 47 |

It is confirmed from Table 9 that the products of the present invention having the composite layers including the porous metallic bodies have improved wear resistance compared with the comparative product without composite layer. Composite layers of the oil pump housing of product 15 were observed to find that just a few portions of the hollow skeleton of the porous metallic body were not impregnated with aluminum alloy. Regarding product 16 of the present invention, there was no such portion that was not impregnated with aluminum alloy. It is understood from this result that the porous metallic body produced by sintering has the solid skeleton structure and there is thus no portion that is not impregnated with aluminum alloy in the composite layer including aluminum alloy, and accordingly, such a porous metallic body is more preferable.

EXAMPLE 5

TABLE 10

| Sample No. | Iron Oxide Powder (mass %) | Ferrochrome Alloy Powder (mass %) | Phenol Resin (mass %) | Dispersing Agent (mass %) | Water (mass %) |
|---|---|---|---|---|---|
| Slurry R | 59 | 23 | 6 | 1.5 | 10.5 |
| Slurry S | 55 | 25 | 8 | 1.5 | 10.5 |
| Slurry T | 53 | 25 | 10 | 1.5 | 10.5 |
| Slurry U | 48 | 30 | 10 | 1.5 | 10.5 |
| Slurry V | 40 | 35 | 13 | 1.5 | 10.5 |
| Slurry W | 37 | 35 | 16 | 1.5 | 10.5 |

As shown in Table 10, slurries R–W were prepared containing iron oxide powder (average particle size 0.5 μm), ferrochrome alloy powder (Cr: 63 mass %, average particle size 5 μm), phenol resin, dispersing agent, and water such that the ratio between respective components differed depending on the slurry.

Urethan foam was used as a base material, and the urethan foam was impregnated with the above-described slurry. A metal roller was used to remove excessively adhering slurry and the remaining slurry was dried. After this, annealing in nitrogen at 1100° C. and further annealing in vacuum at 1200° C. were performed for 10 minutes and for 30 minutes respectively to produce a porous metallic body.

Vickers hardness of the metal constituting the porous metallic body was measured. Porous metallic bodies r-w shown in Table 11 were processed according to the shape of the composite layer in FIG. 1.

TABLE 11

| Sample No. | Used Slurry | Vickers Hardness (Hv) | Cr Composition (mass %) | Remaining Carbon Amount (mass %) | Thickness of Porous Metallic Body (mm) | Average Pore Diameter of Porous Metallic Body (mm) | Volume Fraction (%) |
|---|---|---|---|---|---|---|---|
| Porous Metallic Body r | R | 80 | 22 | 0.002 | 10 | 0.5 | 9 |
| Porous Metallic Body s | S | 100 | 24 | 0.13 | 10 | 0.5 | 9 |
| Porous Metallic Body t | T | 120 | 25 | 0.35 | 10 | 0.5 | 9 |
| Porous Metallic Body u | U | 300 | 29 | 0.35 | 10 | 0.5 | 9 |
| Porous Metallic Body v | V | 1000 | 35 | 2.5 | 10 | 0.5 | 9 |
| Porous Metallic Body w | W | 1200 | 36 | 3.8 | 10 | 0.5 | 9 |

Pores of the porous metallic body were impregnated, under a pressure of 40 MPa, with aluminum alloy (JIS AC8A) that was melt by heat at a temperature of 780° C. An oil pump housing was accordingly produced. For comparison, an oil pump housing made of aluminum alloy (JIS AC8A) with no composite layer was produced. The inner rotor and the outer rotor shown in FIG. 1 were set in each of these oil pump housings to produce oil pumps (products 17–22 of the present invention and comparative product 5) that were operated under the conditions shown in Table 2. After the operation, the wear amount of the portion where the composite layer was formed (for the comparative product, the portion corresponding to the composite layer of the product of the present invention) was measured. Results are shown in Table 12.

TABLE 12

| Sample No. | Used Porous Metallic Body | Wear Amount (μm) |
|---|---|---|
| Present Invention 17 | r | 31 |
| Present Invention 18 | s | 11 |
| Present Invention 19 | t | 6 |
| Present Invention 20 | u | 5 |
| Present Invention 21 | v | 13 |
| Present Invention 22 | w | 23 |
| Comparative Product 5 | None | 47 |

It is seen from Table 12 that the products of the present invention have composite layers including porous metallic bodies and thus have enhanced wear resistance compared with the comparative product with no composite layer. Further, it is understood that the Vickers hardness is preferably at least 100 and at most 1000, and more preferably at least 120 and at most 300. It is noted that the porous metallic body employed for product 22 of the present invention was brittle and defects such as cracks occurred in the prefoam before the composite product including aluminum alloy was produced. After the oil pump was operated, some portions exhibited progress of wear due to defects and loss of the porous metallic body.

EXAMPLE 6

Urethan foam materials having respective average pore diameters different from each other were each impregnated with slurry containing 52 mass % of iron oxide powder (average particle size 0.5 μm), 23 mass % of ferrochrome alloy powder (Cr: 63 mass %, average particle size 5 μm), 13 mass % of phenol resin binder, 1.5 mass % of dispersing agent, and 10.5 mass % of water. A metal roller was used to remove excessively adhering slurry and the remaining slurry was dried. After this, annealing in nitrogen atmosphere at 1100° C. and further annealing in vacuum at 1200° C. were performed respectively for 10 minutes and for 30 minutes to produce iron-chrome porous metallic bodies (Fe—Cr porous metallic bodies) with respective average pore diameters different from each other.

These porous metallic bodies were each set in a mold and impregnated with aluminum alloy (JIS AC8A) that was melt by heat at 780° C. with pressure applied thereto and accordingly a required minimum impregnation pressure was determined that would not generate any portion which was not impregnated with aluminum alloy. Results are shown in Table 13.

TABLE 13

| Sample No. | Average Pore Diameter of Porous Metallic Body (mm) | Required Impregnation Pressure (MPa) |
|---|---|---|
| 23 | 0.08 | 4.0 |
| 24 | 0.1 | 1.7 |
| 25 | 1.5 | 0.8 |
| 26 | 3.0 | 0.3 |
| 27 | 4.0 | 0.2 |

The required impregnation pressures for samples 24–26 having optimum average pore diameters according to the present invention are within the range of so-called low pressure die casting to which gas pressurization is also applicable. Applicability of the low pressure die casting provides numerous advantages such as low equipment cost and reduced limitations of the mold shape. It is understood from this result that the oil pump according to the present invention can be produced by selecting any of forging cast process, die casting process and low pressure die casting process according to use and purpose.

The embodiment and examples of the present invention have heretofore been discussed. Various modifications are possible for the embodiment herein described. According to the embodiment, the present invention is applied to the gear pump. However, the present invention is applicable to vane pumps. Further, the oil pump housing may be structured of any aluminum alloy containing a great amount of silicon, instead of the aluminum alloy described above. The inner rotor and outer rotor may also be constituted of any of iron alloy, aluminum alloy and other metals.

According to the present invention, an oil pump can be provided that can be reduced in weight, and is excellent in wear resistance and easy to manufacture.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An oil pump comprising:

an oil pump housing formed of aluminum alloy; and a pump element sliding along said oil pump housing with contact kept therebetween to suck and discharge oil, a porous metallic body being arranged at a part of said oil pump housing that contacts said pump element, and pores of said porous metallic body being impregnated with the aluminum alloy forming said oil pump housing.

2. The oil pump according to claim 1, wherein said pump element has a revolving rotor and said porous metallic body is arranged at a part contacting a side surface of said rotor.

3. The oil pump according to claim 1, wherein said pump element has a revolving rotor and said porous metallic body is arranged at a part contacting peripheral surface of said rotor.

4. The oil pump according to claim 1, wherein the pores of said porous metallic body have an average pore diameter of at least 0.1 mm and at most 3.0 mm.

5. The oil pump according to claim 1, wherein said porous metallic body has a volume fraction of at least 2% and at most 30%.

6. The oil pump according to claim 1, wherein said porous metallic body includes at least one selected from iron, nickel and chrome.

7. The oil pump according to claim 1, wherein said porous metallic body is produced by sintering.

8. The oil pump according to claim 1, wherein said porous metallic body is constituted of metal having a Vickers hardness of at least 100 and at most 1000.

9. The oil pump according to claim 8, wherein said porous metallic body is constituted of metal having a Vickers hardness of at least 120 and at most 300.

10. The oil pump according to claim 1, wherein said oil pump housing is produced by using any of squeeze cast process, die casting process and low pressure die casting process to make the composite of said porous metal and said aluminum alloy through casting.

* * * * *